US006834718B2

(12) United States Patent
Webster

(10) Patent No.: US 6,834,718 B2
(45) Date of Patent: Dec. 28, 2004

(54) CASING HEAD CONNECTOR WITH LANDING BASE

(75) Inventor: Matthew Thomas Robinson Webster, Edmonton (CA)

(73) Assignee: Stream-Flo Industries, Ltd., Edmonton (CA)

( * ) Notice: Subject to any disclaimer, the term of this patent is extended or adjusted under 35 U.S.C. 154(b) by 202 days.

(21) Appl. No.: 10/325,623

(22) Filed: Dec. 19, 2002

(65) Prior Publication Data

US 2003/0121653 A1 Jul. 3, 2003

Related U.S. Application Data

(60) Provisional application No. 60/342,269, filed on Dec. 21, 2001.

(51) Int. Cl.[7] ..... E21B 33/04; E21B 33/038; E21B 19/10; E21B 33/03

(52) U.S. Cl. ..... 166/89.3; 166/75.13; 166/382; 166/89.1

(58) Field of Search ..... 166/378, 379, 166/380, 381, 382, 75.11, 77.51, 85.1, 85.5, 75.13, 89.1, 89.3

(56) References Cited

U.S. PATENT DOCUMENTS

| | | | | | |
|---|---|---|---|---|---|
| 2,338,767 | A | * | 1/1944 | Humason | 166/68.5 |
| 2,704,579 | A | * | 3/1955 | Brown | 166/312 |
| 2,874,437 | A | | 2/1959 | Anderson | 188/67 |
| 3,068,027 | A | | 12/1962 | Lewis et al. | 285/123.8 |
| 4,402,535 | A | * | 9/1983 | Bridges | 285/123.11 |
| 4,494,778 | A | | 1/1985 | Johnson | 285/146 |
| 4,552,213 | A | * | 11/1985 | Boyd et al. | 166/88.4 |
| 4,646,827 | A | * | 3/1987 | Cobb | 166/88.2 |

(List continued on next page.)

FOREIGN PATENT DOCUMENTS

| | | | |
|---|---|---|---|
| CA | 20159661 | 7/1991 | 166/47 |

OTHER PUBLICATIONS

Walker Steel, FGR Casing Head (Product Information), as found in (1993) *Wellhead Equipment Catalogue*, Walker Steel (A division of EMCO) at 17.

Cameron, Casing Head Bottom Connection Options (Product Information), as found in (1998) *Cameron Conventional Surface Wellheads*, Cooper Cameron Corporation, Cameron Division, Catalogue ID #TC1261, at 19.

(List continued on next page.)

*Primary Examiner*—David Bagnell
(74) *Attorney, Agent, or Firm*—Greenlee, Winner and Sullivan, P.C.

(57) ABSTRACT

A connector head, for transferring at least a portion of the load from an inner tubular body onto an outer tubular body, comprises a generally tubular connector head formed with a central bore through which the inner tubular body extends. The connector head has an inwardly extending stop shoulder to allow the connector head to rest on the upper end of the inner tubular body. A slip connecting means is located in the connector head for gripping the outer wall of the inner tubular body. A base plate, formed with a central bore therethrough, is located below the connector head and is adapted to rest on the upper end of the outer tubular body. A retainer ring, formed with a central bore therethrough, is located between the connector head and the base plate and includes a plurality of threaded stud members extending therethrough allowing the retainer ring to slide upwardly and downwardly on the threaded stud members. Tightening of upper nuts against the retainer ring pushes the retainer ring upwardly to force the slip to grip the inner tubular body, and downward tightening of lower nuts against the base plate transfers at least a portion of the load from the inner tubular body to the base plate and the outer tubular body.

12 Claims, 2 Drawing Sheets

U.S. PATENT DOCUMENTS

| | | | | | |
|---|---|---|---|---|---|
| 4,690,221 | A | * | 9/1987 | Ritter, Jr. | 166/382 |
| 4,790,379 | A | | 12/1988 | Vanderford, Jr. | 166/208 |
| 4,799,714 | A | | 1/1989 | Collet | 285/145 |
| 4,828,293 | A | | 5/1989 | Vanderford, Jr. et al. | 285/147 |
| 4,913,469 | A | | 4/1990 | Baugh | 285/146 |
| 4,936,382 | A | | 6/1990 | Thomas | 166/88 |
| 4,982,795 | A | | 1/1991 | King | 166/382 |
| 5,135,266 | A | | 8/1992 | Bridges et al. | 285/144 |
| 5,205,356 | A | | 4/1993 | Bridges et al. | 166/85 |
| 5,299,644 | A | * | 4/1994 | Eckert | 166/379 |
| 5,332,043 | A | | 7/1994 | Ferguson | 166/379 |
| 5,996,695 | A | | 12/1999 | Koleilat et al. | 166/382 |
| 6,015,009 | A | | 1/2000 | Allen | 166/89.3 |
| 6,095,242 | A | | 8/2000 | Lequang et al. | 166/88.2 |

OTHER PUBLICATIONS

Cameron, CAMFORGE™ Casing Connection System (Product Information), as found in *Composite Catalogue of Oilfield Equipment and Services, 42nd Edition*, vol. 1 (A–G), World Oil, 1996–1997, at 403; online: Cameron, Camforge Connection System Products, connectors, updated Jun. 14, 2001: <http://www.camerondiv.com/cgi–bin/cam.dll/cam/scripts/products/documentsView.jsp?BV_SessionID=@@@@0133616862.1046460093@@@@&BV_EngineID=cccdadchifeiiihcgeicfgkdghldffg.0&oid=1072340&Level1=&DOC_TYPE=1&PRODUCT_NAME=CAMFORGE%20Connection%20System>(date accessed Sep. 30, 2002).

* cited by examiner

CASING HEAD CONNECTOR WITH LANDING BASE

CROSS REFERENCE TO RELATED APPLICATION

This application claims priority from U.S. Provisional Patent Application No. 60/342,269 filed Dec. 21, 2001. To the extent that it is consistent herewith, the aforementioned application is incorporated herein by reference.

FIELD OF THE INVENTION

This invention provides a means of connecting a casing head, or other attachment, to string of tubular body such as a casing pipe, and in addition provides a means of transferring a portion of the load of that attachment onto a conductor pipe or other tubular body.

BACKGROUND OF THE INVENTION

The typical fashion in which a well is drilled in the ground, for example for oil and gas, is to first drive or drill a shallow large diameter pipe, commonly called the conductor pipe, into the ground and to then drill a smaller and deeper hole inside the boundary defined by the conductor pipe so that a smaller diameter and longer pipe, commonly called the surface casing or casing pipe, can be placed into the hole. The annular space between the surface casing and the conductor pipe is then be filled with cement. Further drilling beyond the depth of the surface casing is done to a sufficient depth that geological formations encountered may cause pressurized fluid to escape into the hole and travel the surface. To control this fluid, and to prevent its escape into the atmosphere, the drilling is done through a sealed pressure vessel at the surface that is known as the blowout preventer stack. In addition, drilling at these depths require the use of a weighted column of fluid, known as drilling mud, to control the well and to aid drilling by cooling the drilling bit and to remove cut rock. A pressure vessel known as the casing head, attaches to and seals on around the surface casing to provide a means of hooking up the blowout preventer stack and the drilling mud lines. This casing head is commonly attached to the surface casing by either threading it onto the casing pipe or by welding it to the casing pipe. The problems with these methods of attaching the casing head are that they require time, are often expensive and create the possibility of installation errors.

A third method is to attach the casing head using a means for gripping the casing pipe with mechanically activated teeth. A seal between the casing head and the casing pipe is then provided separately, usually in the form of an elastomeric or metal seal ring located in the casing head above the mechanical gripping mechanism. Such an assembly is well known in the industry and commonly used but is described adequately in U.S. Pat. No. 4,799,714 issued to Collet, U.S. Pat. No. 5,332,043 issued to Ferguson, and Canadian Patent 2,015,966 issued to Anderson et al. Each of these patents describes a common method for mechanically attaching the casing head to the surface casing. They disclose the use of conical slip segments which surround the casing pipe, each slip segment being provided with a plurality of grooves on their straight inside surface (casing pipe-contacting surface) that act as teeth that bite into the surface casing. A housing, or actuation sleeve, with a reverse conical mating surface to the conical surface on the outside of the slip segments, is then driven against the slip segments (or the slip segments are driven against the sleeve/housing). This forces the slip segments against the surface casing pipe causing the grooves to frictionally grip (or the teeth to bite into) the casing pipe, and thus to secure the casing pipe to the casing head. These slip segments are commonly referred to as "slips" and the system is commonly described as a slip lock casing connector.

This slip lock casing connector has advantages over the previously described casing connectors. These include the reduced installation time, the ability to ensure that a seal between the casing pipe and the casing head has been achieved, and the ability to remove the casing head if drilling is abandoned.

Once the casing head has been attached, by any of the three means described above, drilling is continued to a deeper depth. An additional, smaller, string of pipe is then set in the hole and the weight of this pipe is supported by the casing head. Further drilling steps could include setting of additional strings of pipe within the casing pipe, and installing additional heads above the casing head. The weight from the additional strings and heads can prove to be too large for the surface casing string to support alone, so some means of transferring this load onto the conductor pipe may be required. The equipment that transfers this load is known as the landing base. The landing base usually consists of a landing plate set on top of the conductor pipe, together with a means for setting the casing head on, or securing the casing head to, this landing plate. It can be extremely difficult to supply a landing base with a casing head using a slip lock connector as described above because the landing base interferes with the operator's access to the mechanical actuation means of the casing connector. In addition, the casing head normally requires a special means of attachment to the landing base, and as such, the landing base cannot be fitted onto a standard slip lock casing head. The solution to these problems often leads to an awkward and complex system that can be extremely costly.

Commonly, the mechanical actuation means of the slip lock casing connector consists of studs or bolts that pull the actuation sleeve against the slip segments or push the slip segments against the actuation sleeve. In order to reduce the size of the entire assembly, these bolts or studs normally extend out below the bottom of the casing head. The use of a landing base interferes with access to the bolts of the mechanical actuation means, which requires the bolts to extend out of the top face of the bottom casing head (i.e., upwards out of the top face of a flange on the bottom of the casing head). This in turn requires the casing connector parts to be larger so that the bolts or studs clear the outside diameter of the casing head leading to a redesign of the slip lock casing head and an increased cost.

SUMMARY OF THE INVENTION

An objective of this invention is to establish a mechanical means of attaching a casing head or other attachment onto a piece of surface casing pipe or other pipe. The invention allows a landing base to be easily attached to the casing head. This invention reduces manufacturing costs of this combined casing head and landing base when compared to other available designs. Preferably, the invention allows the operator to establish and adjust the portion of load transferred from the surface casing onto the conductor pipe. Finally, the invention is easy to use and less awkward then available designs.

Broadly stated, the invention provides a connector head for connecting an inner tubular body within an outer, concentric tubular body, and for transferring at least a portion of the load from the inner tubular body onto the outer tubular body. The connector head of the invention comprises:

a generally tubular connector head formed with a central bore through which the inner tubular body extends, the connector head having an inwardly extending stop shoulder formed in the central bore to allow the connector head to rest on the upper end of the inner tubular body;

slip connecting means in the connector head for gripping the outer wall of the inner tubular body;

a base plate formed with a central bore through which the inner tubular body extends, the base plate being located below the connector head and adapted to rest on the upper end of the outer tubular body, the base plate being formed with a plurality of radially spaced holes;

a plurality of threaded stud members connected to and extending radially downwardly from the lower end of the connector head, for mating arrangement with the radially spaced holes of the base plate;

a retainer ring formed with a central bore through which the inner tubular body extends, the retainer ring being located between the connector head and the base place, and being connected to or in contact with the slip connecting means such that upward movement of the retainer ring engages the slip connecting means into a gripping mode with the inner tubular body, the retainer ring being formed with a plurality of radially spaced holes through which the threaded stud members extend, allowing the retainer ring to slide upwardly and downwardly on the threaded stud members; and an upper and lower nut threaded onto each of the threaded stud members between the retainer ring and the base plate, such that tightening of the upper nuts against the retainer ring pushes the retainer ring upwardly to engage the slip connecting means into the gripping mode with the inner tubular body, and downward tightening of the lower nuts against the base plate transfers at least a portion of the load from the inner tubular body through the threaded stud members and lower nuts onto the base plate and the outer tubular body.

In a preferred embodiment, the connector head of the invention is a casing head device for use in a well bore, wherein the inner tubular body is a casing pipe and wherein the outer tubular body is a conductor pipe. In this embodiment the invention provides a casing head device for connecting and sealing to a casing pipe and for transferring at least a portion of the load from the casing pipe to an outer, concentric conductor pipe.

DESCRIPTION OF THE PREFERRED EMBODIMENTS

Figure 1:
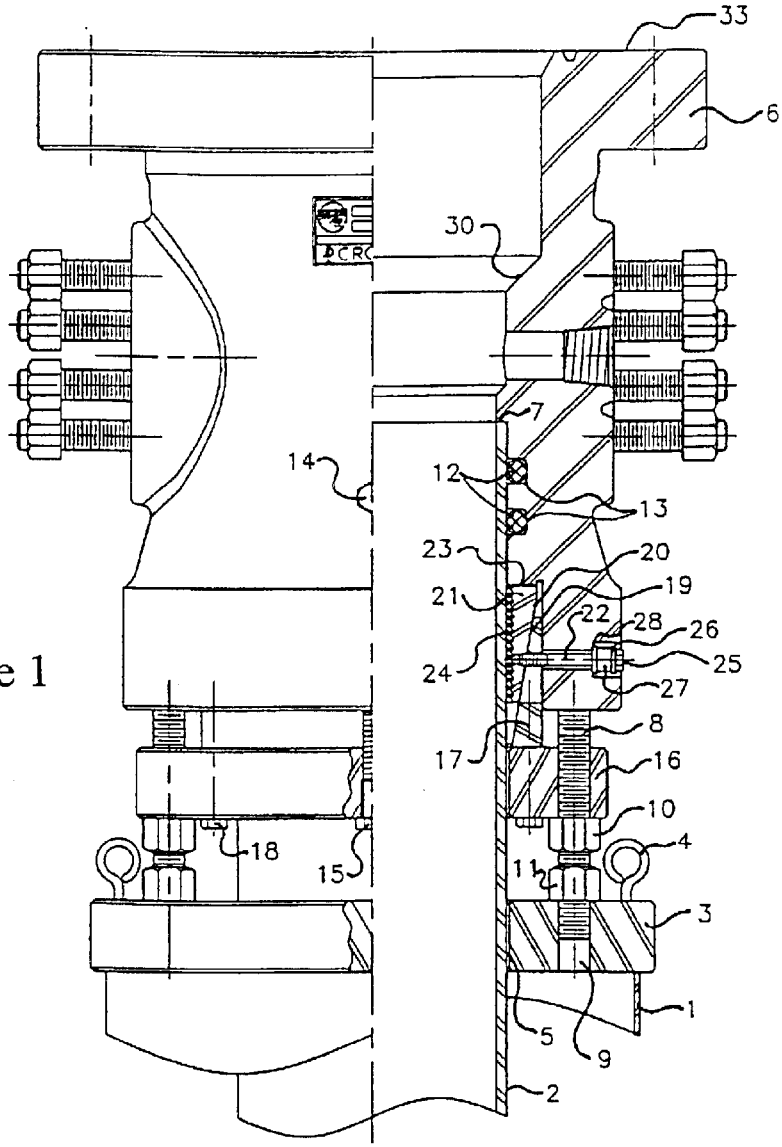
FIG. 1 is a front view of the assembly of the present invention including a casing head with the slip lock retention bottom connection attached to the adjustable landing base. This figure shows the components in their positions just after the casing head has been placed over the casing pipe and before the slip lock connector and the landing base have been energized so as to grip the casing pipe and transfer load to the landing base plate and to the conductor pipe. The view is a half and partial section in order to illustrate the components. It should be noted that for clarity some components might be shown out of plane.

The invention is described with reference to FIG. 1, so as to describe the installation of the casing connector, landing base assembly of this invention, and its operation in subsequent drilling operations. After a conductor pipe 1 and surface casing pipe 2 is drilled for and set in the drill hole, a base plate 3 is picked up using the lifting eyes 4 and centered over the surface casing pipe 2 and conductor pipe 1. The base plate 3 has a hole 5 (or central bore) through its center being slightly larger in diameter than the surface casing pipe 2. The base plate 3 is placed onto the top of the conductor pipe 1 with the surface casing pipe 2 protruding through its center hole 5. The base plate 3 thus acts as a landing base. A casing head 6 is then placed over the surface casing pipe 2 such that a stop shoulder 7 in the casing head 6 rests on the top of the surface casing pipe 2. Threaded studs 8, which are threaded into the bottom of the casing head 6, are lined up with, and fit into, the radial holes 9 which are formed in the base plate 3. Upper nuts 10 and lower nuts 11 are threaded to move upwardly and downwardly respectively on studs 8 between the base plate 3 and a retaining ring 16 located at the bottom of the casing head 6. These nuts 10, 11 are initially in a high enough vertical position to ensure that the casing head 6 does not yet rest on the base plate 3.

The casing head 6 has seal means for sealing the casing head 6 against the casing pipe 2. The seal means preferably include at least two seals 12 located in sealing grooves 13 below the stop shoulder 7 which seal against the casing pipe 2. These seals 12 can consist of elastomeric seals, metal-to-metal seals or a combination of the two. The seals 12 may or may not require external energization to achieve a seal. A pressure test is preferably then performed on the seals 12 to ensure the casing head 6 is sealing on the surface casing pipe 2. For that purpose, one or more pressure test ports 14 are provided, which can be accessed from the outside of the casing head 6. After the pressure integrity of the seals 12 has been verified the outer capscrews 15 in the retainer ring 16 are backed off so they no longer extend above the top face of the retainer ring 16. These capscrews 15 are used to ensure an initial proper gap between the top face of the retainer ring 16 during installation and to aid in removing the casing head 6. The upper set of nuts 10 are tightened so that as they move up the studs 8, they engage the retainer ring 16 and push it upwardly. The retainer ring 16 in turn engages the actuation sleeve 17 and pushes it upwardly.

In FIG. 1, the retainer ring 16 and actuation sleeve 17 are shown as separate parts joined by capscrews 18. This is for ease of manufacture, but they may form a single component in alternate embodiments of the invention. The need for the capscrews 18 would then be eliminated. As the actuation sleeve 17 is pushed upwardly, its inner conical surface 19 engages on the mating outer conical surface 20 of the slip segments 21. These slip segments 21 (preferably four) are attached to the casing head 6 by the horizontal capscrews 22. The slip segments 21 are restrained from vertical movement by the slip stop 23 in the casing head 6. Thus, as the nuts 10 are tightened against the retainer ring 16, the upward vertical movement of the actuation sleeve 17 pushes the slip segments 21 inwardly. This upward movement caused the straight grooves 24 (or teeth) of the slip segments 21 to be pushed against the surface casing pipe 2 and to frictionally grip the casing pipe 2 or bite into it.

As the slip segments move inwardly, they pull the head 25 of the horizontal capscrews 22 against the outer washer 26, which compresses the rubber washer 27 as it is pushed against the inner washer 28. This allows the slip segment 21 to move inwardly without loosening the horizontal capscrews 22. After the slip segments 21 have fully compressed the rubber washer 27, the horizontal capscrews 22 are partially loosened before continuing tightening of the upper set of nuts 10. After the upper set of nuts 10 have been tightened to the desired torque the casing head 6 is secured to the surface casing pipe 2 and any vertical force applied to the casing head 6 will not remove it from the surface casing pipe 2. This vertical force can result in the event that well pressure is present in the hole during subsequent drilling operations. Any applied vertical force will pull the casing head 6 upwardly, thereby pulling the studs 8, upper set of nuts 10, the retainer ring 16 and actuation sleeve 17 upwardly. As described above, this causes the slip segments 21 to grip the surface casing pipe 2 with greater force so any vertical force attempting to separate the casing head from the surface casing pipe 2 will only secure it more tightly. Once the casing head 6 has been secured to the surface casing pipe 2, the lower set of nuts 11 are tightened so that they move down on the studs 8 and engage on the base plate 3.

Figure 2:
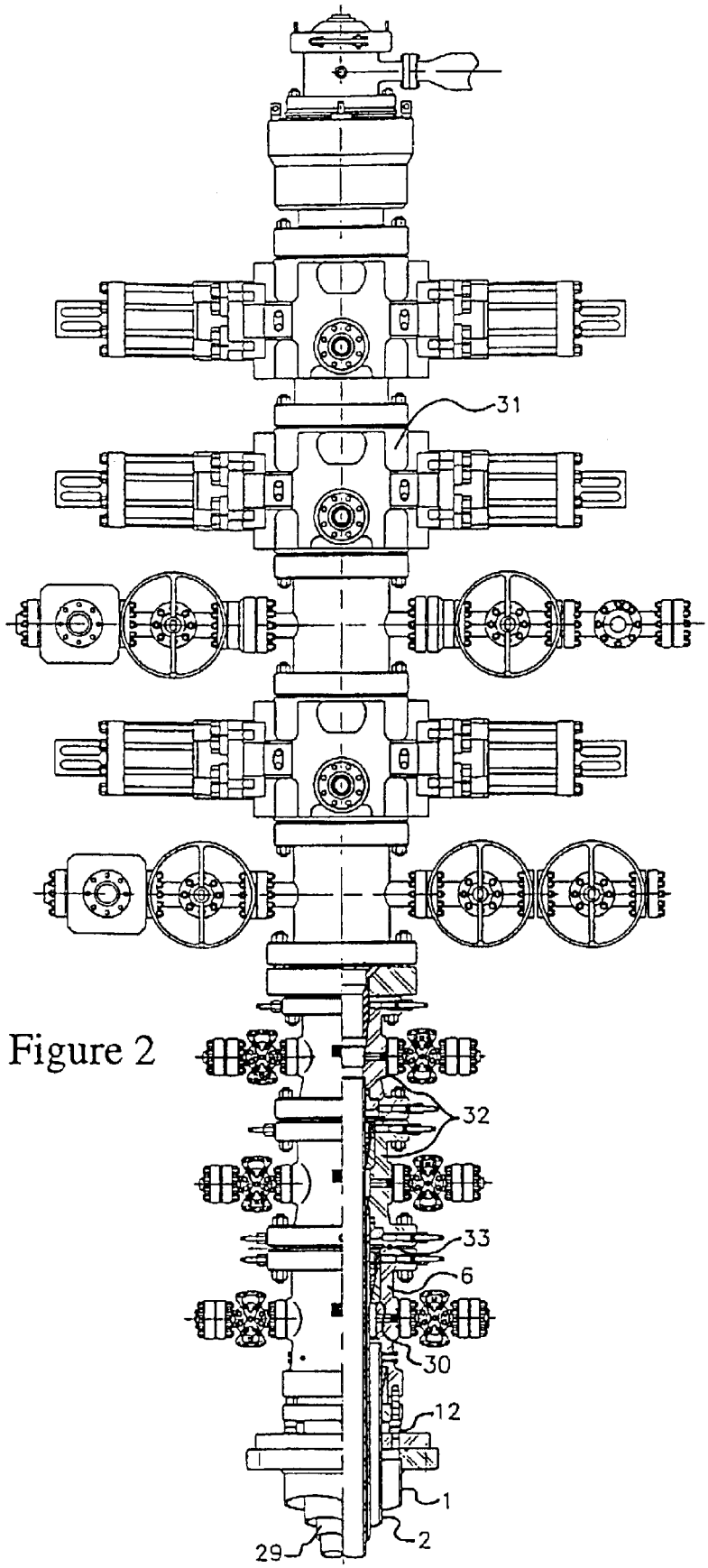
FIG. 2 is a front view (in the same orientation as in FIG. 1) of the described invention installed in a typical wellhead stack with equipment typically used in drilling operations. The wellhead equipment is shown in half section with the blowout preventer stack unsectioned.

FIG. 2 shows the casing head connector, landing base assembly of this invention in use with subsequent drilling operations underway. A portion of the load placed on the casing head 6 is now transferred onto the conductor pipe 1 rather than resting entirely on the surface casing pipe 2. This load may be the result of additional strings of pipe 29 landed on the load shoulder 30 of the casing head 6, or from the blowout preventer stack 31 and additional heads 32 landed onto the upper face 33 of the casing head 6. The amount of load transferred to the conductor pipe 1 is a function of the relative elasticities of the surface casing pipe 2 and the conductor pipe 1. While this load is usually unknown, the assembly of this invention allows the apportioning of the load to be adjusted. The load carried by the conductor pipe 1 can be measured by measuring the torque on the lower set of nuts 11, and can be controlled or adjusted by changing the torque applied. The relationship between the torque of a nut and the resulting vertical load is a commonly used engineering formula known to all skilled in the art.

Referring again to FIG. 1, load can be transferred from the surface casing pipe 2 to the conductor pipe 1 by two methods. In the first method, load can be transferred from the casing head 6 onto the conductor pipe 1 through the studs 8, onto the lower set of nuts 11, onto the base plate 3 and onto the conductor pipe 1. The second method allows the load to be transferred onto the slip segments 21 which act against the surface casing pipe 2 and transfer the load to the actuation sleeve 17. This actuation sleeve then transfers the load to the retainer ring 16, which transfers the load to the upper set of nuts 10. This load is then transferred onto the conductor pipe 1 by means of the first method described above. The amount of load transferred by each method can be determined by calculating the relative elasticities of each system. The stiffer the system governing one of the two methods the more load will be transferred by that method. It is important to make the system of load transfer through the first method much stiffer than the second. This is because the amount of additional load placed on the surface casing pipe 2 by the slip segments 21 should be limited so the casing pipe 2 is not crushed excessively.

The casing head 6 may be removed by loosening the lower set of nuts 11 and then loosening the upper set of nuts 10. If necessary the outer capscrews 15 on the bottom of the retainer ring 16 can be tightened in order to pull the retainer ring 16 and actuation sleeve 17, attached by capscrews 18, downwardly. The slip segments 21 then release the surface casing pipe 2, and the casing head 6 and the base plate 3 can be removed and reused.

It should be understood that the wellhead embodiment of the invention shown in FIG. 2 is merely a preferred embodiment, and that the assembly of this invention can be used in any application where a component (attachment) needs to be securely attached to a tubular body, and the load resulting from this attached component needs to be transferred, in whole or in part, to a second tubular body.

All publications mentioned in this specification are indicative of the level of skill in the art of this invention. All publications are herein incorporated by reference to the same extent as if each publication was specifically and individually indicated to be incorporated by reference.

The terms and expressions used are, unless otherwise defined herein, used as terms of description and not limitation. There is no intention, in using such terms and expressions, of excluding equivalents of the features illustrated and described.

What is claimed is:

1. A connector head for connecting an inner tubular body within an outer, concentric tubular body, and for transferring at least a portion of the load from the inner tubular body onto the outer tubular body, comprising:

a generally tubular connector head formed with a central bore through which the inner tubular body extends, the connector head having an inwardly extending stop shoulder formed in the central bore to allow the connector head to rest on the upper end of the inner tubular body;

slip connecting means in the connector head for gripping the outer wall of the inner tubular body;

a base plate formed with a central bore through which the inner tubular body extends, the base plate being located below the connector head and adapted to rest on the upper end of the outer tubular body, the base plate being formed with a plurality of radially spaced holes;

a plurality of threaded stud members connected to and extending radially downwardly from the lower end of the connector head, for mating arrangement with the radially spaced holes of the base plate;

a retainer ring formed with a central bore through which the inner tubular body extends, the retainer ring being located between the connector head and the base plate, and being connected to or in contact with the slip connecting means such that upward movement of the retainer ring engages the slip connecting means into a gripping mode with the inner tubular body, the retainer ring being formed with a plurality of radially spaced holes through which the threaded stud members extend, allowing the retainer ring to slide upwardly and downwardly on the threaded stud members; and an upper and lower nut threaded onto each of the threaded stud members between the retainer ring and the base plate, such that tightening of the upper nuts against the retainer ring pushes the retainer ring upwardly to engage the slip connecting means into the gripping mode with the inner tubular body, and downward tightening of the lower nuts against the base plate transfers at least a portion of the load from the inner tubular body through the threaded stud members and lower nuts onto the base plate and the outer tubular body.

2. The connector head of claim 1, wherein the connector head is a casing head device for use in a well bore, wherein the inner tubular body is a casing pipe and wherein the outer tubular body is a conductor pipe.

3. A casing head device for connecting and sealing to a casing pipe and for transferring at least a portion of the load from the casing pipe to an outer, concentric conductor pipe, comprising:

a generally tubular casing head formed with a central bore through which the casing pipe extends, the casing head having an inwardly extending stop shoulder formed in the central bore to allow the casing head to rest on the upper end of the casing pipe;

seal connecting means in the casing head for sealing the central bore of the casing head against the outer wall of the casing pipe;

slip means in the casing head for gripping the outer wall of the casing pipe;

a base plate formed with a central bore through which the casing pipe extends, the base plate being located below the casing head and adapted to rest on the upper end of the conductor pipe, the base plate being formed with a plurality of radially spaced holes;

a plurality of threaded stud members connected to and extending radially downwardly from the lower end of the casing head, for mating arrangement with the radially spaced holes of the base plate;

a retainer ring formed with a central bore through which the casing pipe extends, the retainer ring being located between the casing head and the base plate and being connected to or in contact with the slip connecting means such that upward movement of the retainer ring engages the slip connecting means into a gripping mode with the casing, the retainer ring being formed with a plurality of radially spaced holes through which the threaded stud members extend, allowing the retainer ring to slide upwardly and downwardly on the threaded stud members; and an upper and lower nut threaded onto each of the threaded stud members; and retainer ring and the base plate, such that tightening of the upper nuts against the retainer ring pushes the retainer ring upwardly to engage the slip connecting means into the gripping mode with the casing pipe, and downward tightening of the lower nuts against the base plate transfers at least a portion of the load from the casing pipe through the threaded stud members and the lower nuts onto the base plate and the conductor pipe.

4. The casing head device of claim 3, wherein the slip connecting means comprise a plurality of arcuate segmented slips removably received in the casing head, each slip having a conical external surface, and an internal circumferential surface formed with grooves or teeth configured to engage, grip and support the casing pipe.

5. The casing head device of claim 4, wherein the retainer ring includes a slip actuating sleeve positioned around the segmented slips, the slip actuating sleeve having a conical internal surface formed for reverse conical mating with the conical surface of the slips.

6. The casing head device of claim 5, wherein the retainer ring and slip actuating ring are separate parts, connected through a plurality of generally vertical capscrews.

7. The casing head device of claim 6, wherein the retainer ring is provided with generally vertical capscrews which maintain a pre-installation gap between the retainer ring and the lower end of the casing head, and which can be rotated to allow for upward movement of the retainer ring by the tightening action of the upper nuts.

8. The casing head device of claim 7, wherein the casing head provides load transfer from the casing pipe, onto the threaded stud members and the lower nuts, onto the base plate and the conductor pipe.

9. The casing head device of claim 8, wherein the casing head device also provides load transfer from the casing pipe through the segmented slips, the slip actuation sleeve, the retainer ring and the lower nuts onto the base plate and the conductor pipe.

10. The casing head device of claim 9, wherein the load transferred from the casing pipe through the segmented slips, the slip actuation sleeve, the retainer ring and the lower nuts onto the base plate and the conductor pipe is less than the load transferred from the casing pipe, onto the threaded stud members and the lower nuts, onto the base plate and the conductor pipe, to ensure that the casing pipe is not crushed.

11. The casing head device of claim 10, further comprising a plurality of generally horizontal slip capscrews connecting the slip segments, the slip actuating sleeve and the casing head.

12. The casing head device of claim 11, wherein the slip capscrews are provided with seals at their casing head ends which allow for limited inward movement as the slip segments move into gripping mode, so as to seal the slip capscrews against the casing head.

* * * * *